US010981295B2

(12) United States Patent
Jennings

(10) Patent No.: US 10,981,295 B2
(45) Date of Patent: Apr. 20, 2021

(54) UPRIGHT CONCRETE WALL PANEL FORM APPARATUS AND ASSOCIATED METHODS

(71) Applicant: John D. Jennings, Orlando, FL (US)

(72) Inventor: John D. Jennings, Orlando, FL (US)

( * ) Notice: Subject to any disclaimer, the term of this patent is extended or adjusted under 35 U.S.C. 154(b) by 341 days.

(21) Appl. No.: 15/848,247

(22) Filed: Dec. 20, 2017

(65) Prior Publication Data

US 2018/0169897 A1 Jun. 21, 2018

Related U.S. Application Data

(60) Provisional application No. 62/436,582, filed on Dec. 20, 2016.

(51) Int. Cl.

| | |
|---|---|
| ***B28B 7/02*** | (2006.01) |
| ***E04G 17/14*** | (2006.01) |
| ***B28B 1/14*** | (2006.01) |
| ***E04G 17/00*** | (2006.01) |
| ***B28B 7/00*** | (2006.01) |
| ***E04G 19/00*** | (2006.01) |
| *E04G 11/08* | (2006.01) |

(52) U.S. Cl.

CPC ..... *B28B 7/02* (2013.01); *B28B 1/14* (2013.01); *B28B 7/0041* (2013.01); *B28B 7/0088* (2013.01); *E04G 17/002* (2013.01); *E04G 17/14* (2013.01); *E04G 19/003* (2013.01); *E04G 11/085* (2013.01)

(58) Field of Classification Search

CPC ..... B28B 7/02; B28B 7/0041; B28B 7/0088; B28B 1/14; E04G 17/002; E04G 17/14; E04G 19/003; E04G 11/085

See application file for complete search history.

(56) References Cited

U.S. PATENT DOCUMENTS

| | | | | |
|---|---|---|---|---|
| 3,645,490 | A * | 2/1972 | Beasley | B28B 7/02 249/50 |
| 3,774,548 | A * | 11/1973 | Borst | B61L 23/002 105/30 |
| 4,921,204 | A * | 5/1990 | Melfi | B28B 7/02 249/155 |
| 4,952,129 | A * | 8/1990 | Zan | B28B 23/06 425/88 |
| 2006/0011802 | A1* | 1/2006 | Di Cesare | B28B 7/02 249/158 |
| 2013/0020732 | A1* | 1/2013 | Jentsch | E04G 11/28 264/33 |

FOREIGN PATENT DOCUMENTS

| | | | | |
|---|---|---|---|---|
| WO | WO-8304066 | A1 * | 11/1983 | E04G 11/32 |

* cited by examiner

*Primary Examiner* — Leith S Shafi

(74) *Attorney, Agent, or Firm* — Allen, Dyer, Doppelt + Gilchrist, PA

(57) ABSTRACT

An upright concrete wall panel form apparatus includes a back panel form to be secured to a base in an upright position, an adjustable support assembly to be secured to the base adjacent the back panel form, and a movable front panel form supported by the adjustable support assembly in an upright position. The movable front panel form is moveable via the adjustable support assembly between a concrete wall panel prep area position and a concrete wall panel forming position. The movable front panel form is aligned with the back panel form in the concrete wall panel forming position so as to define a gap therebetween to receive concrete for forming at least one concrete wall panel in an upright position.

10 Claims, 8 Drawing Sheets

UPRIGHT CONCRETE WALL PANEL FORM APPARATUS AND ASSOCIATED METHODS

RELATED APPLICATION

This application claims the benefit of U.S. Provisional Application Ser. No. 62/436,582 filed Dec. 20, 2016, the entire contents of which are incorporated herein by reference.

TECHNICAL FIELD

The present disclosure relates to the field of building construction, and more particularly, to the fabrication of concrete wall panels used to form the walls of a building.

BACKGROUND

Tilt-up concrete wall panel construction may be used to construct buildings, such as warehouses and factories, retail and convenience stores, for example. In general, tilt-up concrete wall panel construction uses a concrete wall panel form on a suitable flat surface, which may be the building floor slab or a temporary casting slab. After steel reinforcing bars (rebar) or other reinforcement are placed in the form, the form is filled with concrete.

After the concrete cures, the concrete wall panel form is removed and the concrete wall panels are tilted-up and lifted into place to form a wall section. The concrete wall panels may also be referred to as precast panels. Numerous wall sections generally are attached together and to framing members of the building to form complete walls.

Concrete wall panels vary in height, such as from 8 to 36 feet, for example. As the concrete wall panels increase in height, so do the wall thicknesses. An increased wall thickness for taller concrete wall panels avoids breakage as the walls are titled-up. For example, the wall thickness of a 36 foot tall concrete wall panel is several inches more than the wall thickness of a 16 foot tall concrete wall panel.

Since extra concrete is needed for the taller concrete wall panels, this increases construction material costs. In addition, there may also be an increase in operating costs for the larger cranes having the capacity to handle the taller concrete wall panels with the increased thicknesses.

Other factors to consider are the area needed for the concrete wall panels to be formed and the critical construction path needed for forming the building. In standard tilt-up construction, the concrete wall panels are either poured on top of a temporary slab (i.e., a base) built specifically for this purpose outside of the building to be built or on top of the floor slab inside of the building being built.

When the concrete wall panels are poured on the base, a large area is required. This area is at least equal to the size of the largest concrete wall panel being formed. Sometimes the area needed for the base is not always available. After the concrete wall panels have been formed, the base needs to be demolished and removed.

When the concrete wall panels are poured on top of the floor slab of the building being built, the pouring of a next concrete wall panel cannot start until that floor slab has been poured and cured. This adds time to the construction of the building. Also, the concrete wall panel sits right in the middle of a critical construction path. Consequently, there is a need to reduce the construction time and costs associated with providing concrete wall panels used to form the walls of a building.

SUMMARY

An upright concrete wall panel form apparatus includes a back panel form to be secured to a base in an upright position, an adjustable support assembly to be secured to the base adjacent the back panel form, and a movable front panel form supported by the adjustable support assembly in an upright position. The movable front panel form is moveable via the adjustable support assembly between a concrete wall panel prep area position and a concrete wall panel forming position. The movable front panel form may be aligned with the back panel form in the concrete wall panel forming position so as to define a gap therebetween to receive concrete for forming at least one concrete wall panel in an upright position.

The movable front panel form may be repeatedly moved between the concrete wall panel prep area position and the concrete wall panel forming position a plurality of times so that forming the at least one concrete wall panel in the upright position comprises forming a plurality of concrete wall panels in the upright position, with each concrete wall panel remaining in place while a next concrete wall panel is formed.

Each concrete wall panel may contact an adjacent concrete wall panel so that the concrete wall panels formed after a first concrete wall panel is formed remain in place to be used as a back panel form for a next concrete wall panel to be formed.

Each concrete wall panel that is formed may be orientated on its bottom while in the upright position. Alternatively, each concrete wall panel that is formed is orientated on its side while in the upright position.

The upright concrete wall panel form apparatus may further comprise a pair of side panel forms carried by the movable front panel form or the back panel form so as to cover sides of the gap while in the concrete wall panel forming position.

The adjustable support assembly may comprise a plurality of spaced apart fixed tracks secured to the base, a plurality of spaced apart movable tracks guided by the plurality of spaced apart fixed tracks, and a plurality of support arms carried by the plurality of spaced apart movable tracks. The support arms are configured to support the movable front panel form in the upright position.

Each support arm may be configured to pivot front and back with respect to a corresponding one of the movable tracks so as to vertically position the movable front panel form with respect to the base. Each support arm may be configured to move up and down with respect to a corresponding one of the movable tracks so as to level the movable front panel form with respect to the base. The upright concrete wall panel form apparatus may further comprise a plurality of support arm braces coupled between the plurality of support arms and the plurality of movable tracks.

The upright concrete wall panel form apparatus may further comprise at least one front panel form brace coupled to the movable front panel form, and at least one back panel form brace coupled to the fixed back panel form.

The upright concrete wall panel form apparatus may further comprise a second adjustable support assembly to be secured to the base adjacent the back panel form on a side opposite of the adjustable support assembly. The back panel form may be secured to the base via the second adjustable support assembly so that the back panel form is also movable between the concrete wall panel prep area position and the concrete wall panel forming position.

Another aspect is directed to a method for using an upright concrete wall panel form apparatus as described above. The method comprises moving the movable front panel form via the adjustable support assembly from a concrete wall panel prep area position to a concrete wall panel forming position, with the movable front panel form being aligned with the fixed back panel form in the concrete wall panel forming position so as to define a gap therebetween. Concrete may then be poured within the gap for forming at least one concrete wall panel in the upright position. The movable front panel form is moved via the adjustable support assembly from the concrete wall panel forming position back to the concrete wall panel prep area position.

DETAILED DESCRIPTION

The present disclosure will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate alternate embodiments.

Figure 1:
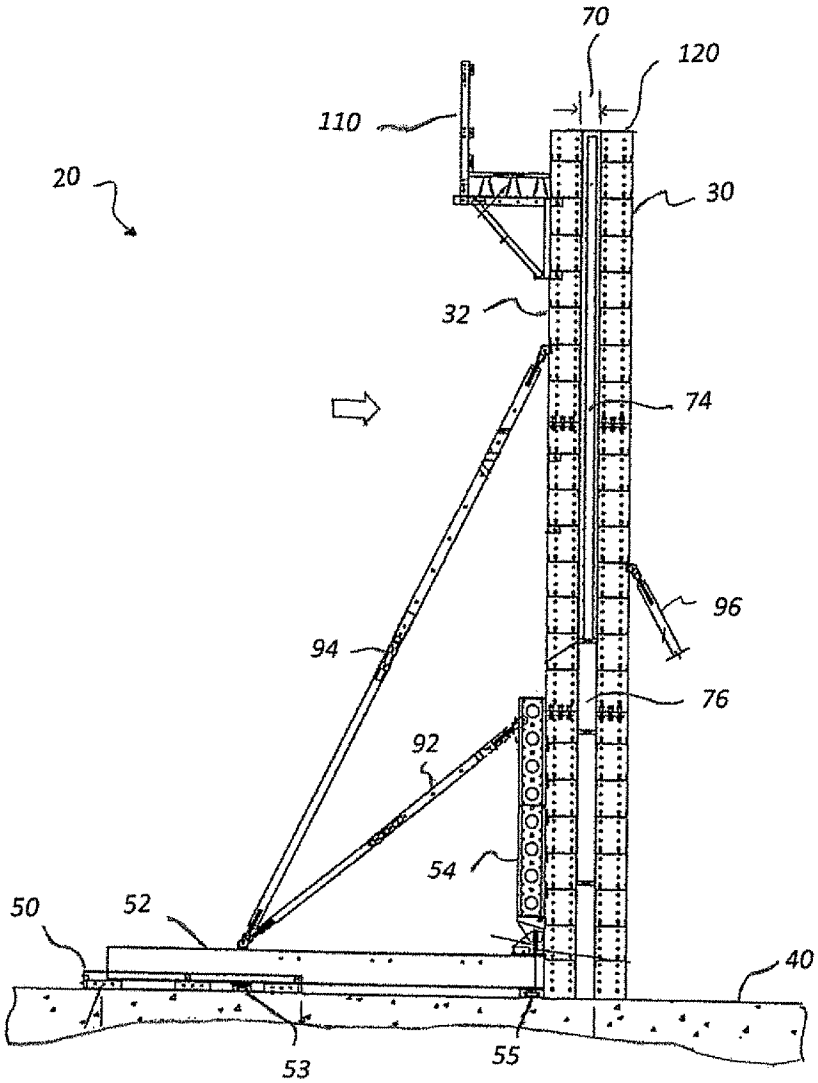
FIG. 1 is a side view of an upright concrete wall panel form apparatus in a concrete wall panel forming position in accordance with the present disclosure.
Figure 2:
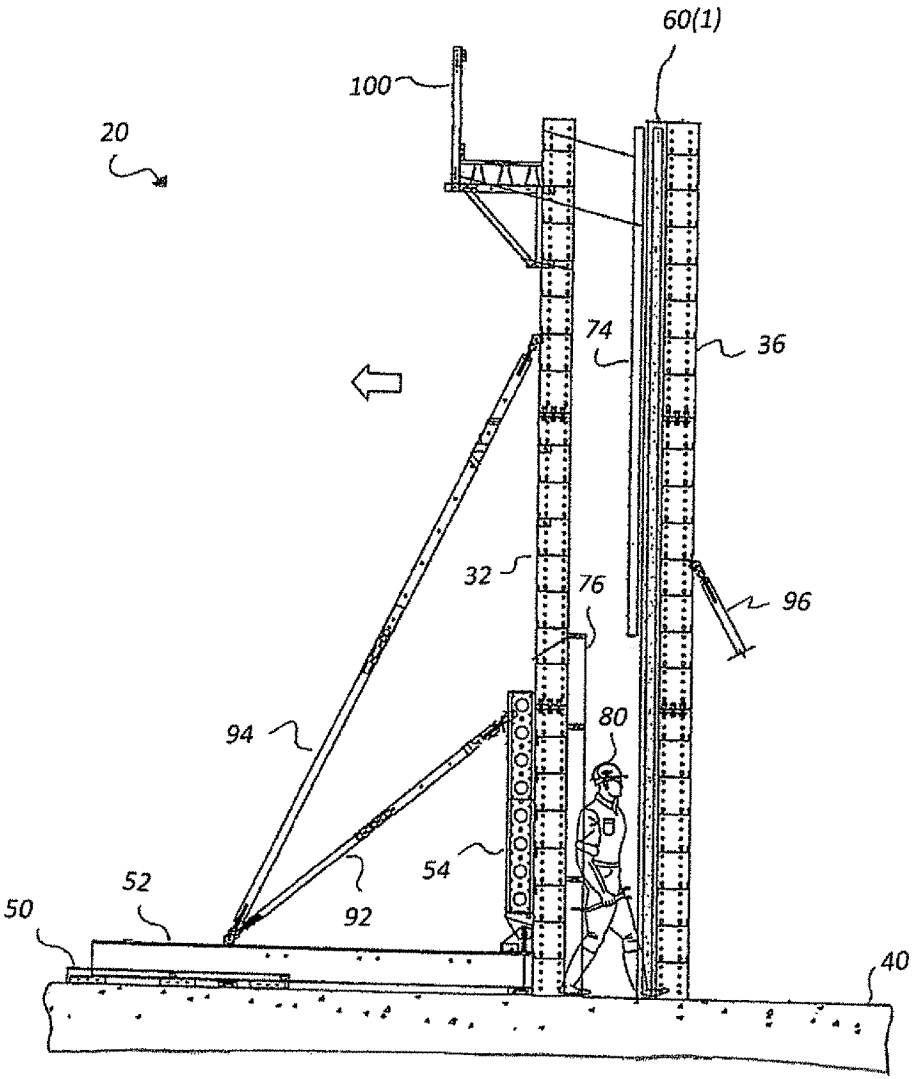
FIG. 2 is a side view of the upright concrete wall panel form apparatus illustrated in FIG. 1 in a concrete wall panel prep area position.
Figure 3:
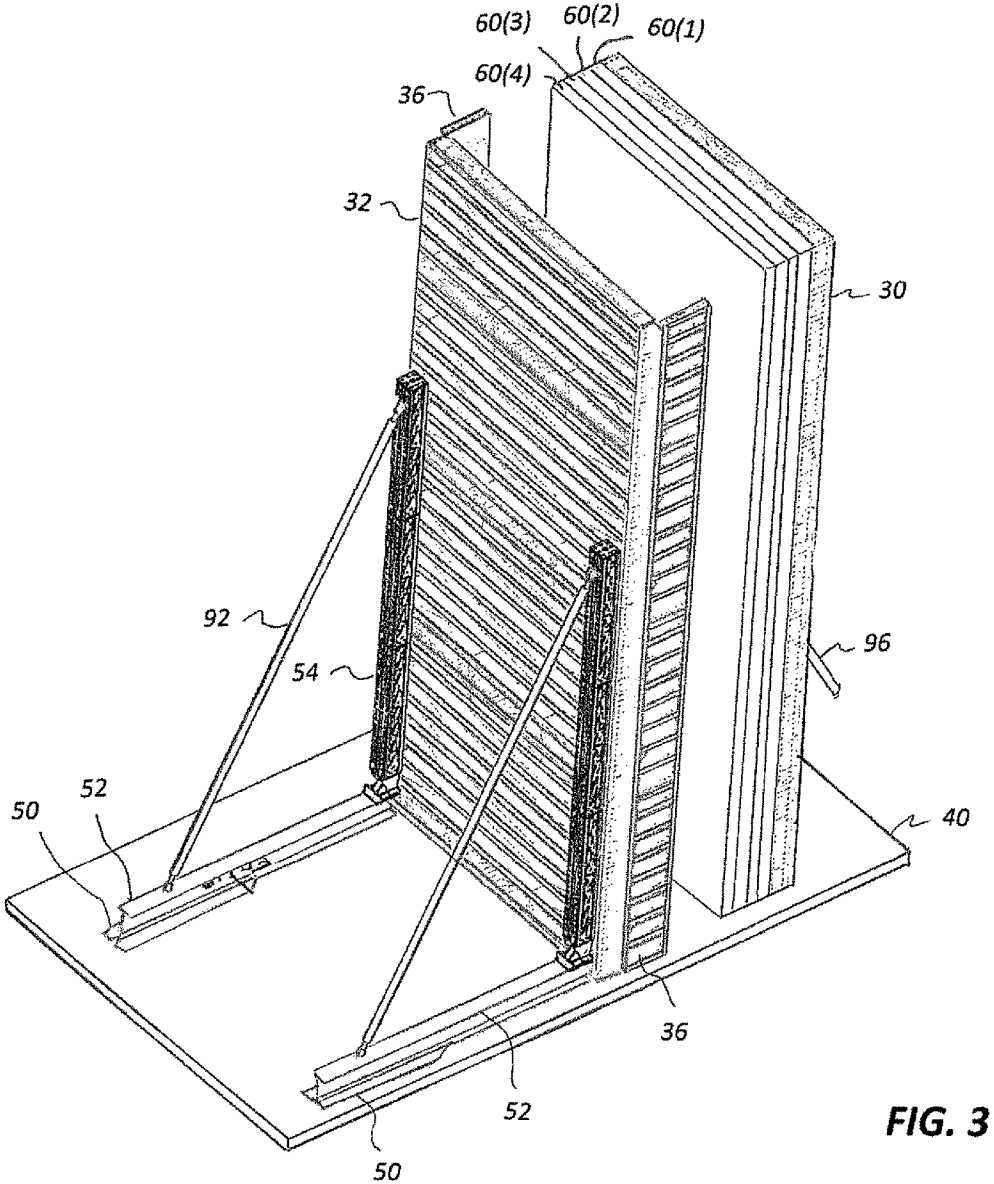
FIG. 3 is a perspective view of the upright concrete wall panel form apparatus illustrated in FIG. 1 in the concrete wall panel prep area position.

Referring initially to FIGS. 1-3, an upright concrete wall panel form apparatus 20 for forming concrete wall panels 60 in an upright position will be discussed. With the concrete wall panels 60 being formed in the upright position, they are then lifted into place to form a wall section of a building under construction. The upright concrete wall panel form apparatus 20 avoids having to form the concrete wall panels 60 in a horizontal position, which then requires them to be tilted-up before being lifted into place.

More particularly, the upright concrete wall panel form apparatus 20 includes a back panel form 30 secured to a base 40 in an upright position, a pair of spaced apart fixed tracks 50 secured to the base 40, and a pair of spaced apart movable tracks 52 guided by the pair of spaced apart fixed tracks.

A pair of support arms 54 is coupled to the pair of spaced apart movable tracks 52. A movable front panel form 32 is secured to the pair of support arms, with the movable front panel form also in an upright position. The fixed tracks 50, the movable tracks 52, and the support arms 54 may also be referred to as an adjustable support assembly.

The spaced apart movable tracks 52, the support arms 54, and the movable front panel form 32 are moveable between a concrete wall panel forming position (FIG. 1) and a concrete wall panel prep area position (FIG. 2). When in the concrete wall panel forming position, a concrete wall panel gap 70 is defined between the movable front panel form 32 and the fixed back panel form 30.

The concrete wall panel gap 70 corresponds to a thickness of the upright concrete wall panel 60 to be formed, which may be about 6 to 12 inches, for example. Steel reinforcing bars 74 are positioned within the concrete wall panel gap 70, and one or more wood block cut outs 76 for doors and windows may also be positioned within the concrete wall panel gap.

A pair of side panel forms 36 is carried by the movable front panel form 32 or the back panel form 30 to cover sides of the concrete wall panel gap 70, as illustrated in FIG. 3. Concrete is to be poured within the gap 70 to form the upright concrete wall panel 60. The concrete is a self-consolidating concrete, which is also known as self-compacting concrete (SCC). The self-consolidating concrete is a highly flowable, non-segregating concrete that easily spreads into place and fills the concrete wall panel gap 70.

As noted above, an advantage of forming the concrete wall panel 60 in the upright position is that the wall panel does not have to be tilted-up from the horizontal position before being lifted into place to form a wall section of the building under construction. Consequently, a thickness of a vertically formed concrete wall panel 60 can be reduced as compared to the thickness needed for a horizontally formed concrete wall panel where breakage is a concern when being tilted-up (i.e., for taller concrete wall panels). As a result, there is a cost savings since less concrete material is needed for vertically formed concrete wall panels 60 where breakage was a concern for horizontally formed concrete wall panels. In addition, a smaller base 40 is needed as compared to a concrete wall panel being formed in a horizontal position, i.e., one that has to be tilted-up after being formed.

Less concrete material also means a savings in weight. Depending on the size of the building being built, less powerful cranes may then be used with lighter weight concrete wall panels. As a result, there may also be a cost savings since less powerful cranes are typically less expensive to operate then the more powerful cranes. The height of the concrete wall panels 60 may vary between 8 feet and 40 feet, for example.

After the concrete wall panel has had sufficient time to cure, such as 12 to 24 hours, for example, then the spaced apart movable tracks 52, the support arms 54, and the movable front panel form 32 are moved from the concrete wall panel forming position to the concrete wall panel prep area position. The front panel form 32 easily separates from the concrete wall panel 60 when a bond breaker is applied to the movable front panel form 32 before being moved to the concrete wall panel forming position, as readily appreciated by those skilled in the art.

Another advantage of the upright concrete wall panel form apparatus 20 is that a second concrete wall panel 60(2) may be formed without moving the first concrete wall panel just formed. For discussion purposes, reference 60 refers to concrete wall panels in general, whereas references 60(1)-60(4) refer to specific concrete wall panels in the order that they are formed. Even though four concrete wall panels 60(1)-60(4) are shown, more concrete wall panels may be formed.

After the initial or first concrete wall panel 60(1) has cured, then the spaced apart movable tracks 52, the support arms 54, and the movable front panel form 32 are moved from the concrete wall panel forming position to the concrete wall panel prep area position.

The concrete wall panel prep area position allows sufficient room for a worker 80 to prep for the next concrete wall panel to be formed between the movable front panel form 32 and the last formed concrete wall panel, such as concrete wall panel 60(1) illustrated in FIG. 2. The separation distance within the concrete wall panel prep area is typically 2 to 3 feet, for example.

Within the concrete wall panel prep area, the movable front panel form 32 may be cleaned and new bond breaker is applied. Bond breaker is also applied to the exposed face of the previously formed concrete wall panel 60(1).

In addition, steel reinforcing bars 74 are placed adjacent the previously formed concrete wall panel 60(1). Separators are used to space the steel reinforcing bars 74 from the previously formed concrete wall panel 60(1), as readily appreciated by those skilled in the art. In addition, wood block cut outs 76 for doors and windows may be secured to the movable front panel form 32, as illustrated, or to the previously formed concrete wall panel 60(1). Bond breaker is also applied to the movable front panel form 32 and the exposed face of the previously formed concrete wall panel 60(1).

The spaced apart movable tracks 52, the support arms 54, and the front panel form 32 are moved from the concrete wall panel prep area position back to the concrete wall panel forming position so that a second concrete wall panel 60(2) is formed. The first formed concrete wall panel 60(1) is now used as a back panel form. This process is repeated to form a desired number of concrete wall panels. As illustrated in FIG. 3, four concrete wall panels 60(1)-60(4) have been formed, with a fifth panel 60(5) still to be formed.

Another advantage of the upright concrete wall panel form apparatus 20 is that the area required to pour the concrete wall panels in minimized. The base 40 remains the same size regardless of how many concrete wall panels 60 are to be formed. The base is a concrete slab, for example, which may be the building floor slab or a temporary casting slab.

Figure 4:
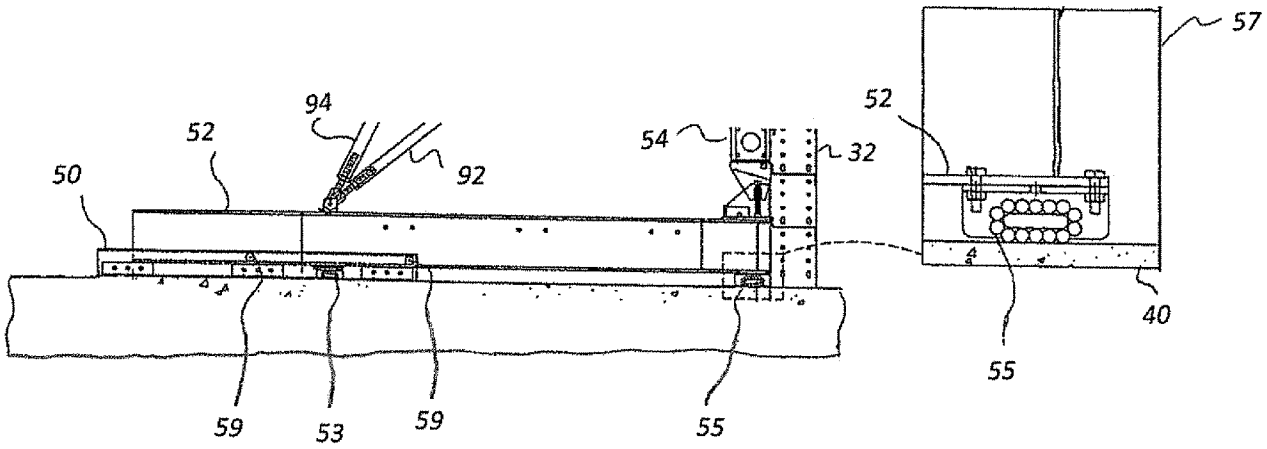
FIG. 4 is an enlarged side view of the fixed track, the movable track, and the support arm illustrated in FIG. 1.
Figure 6:
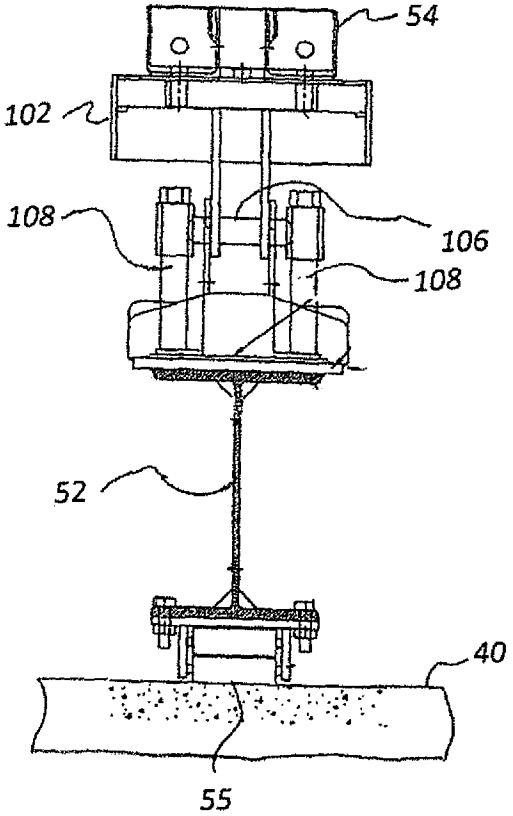
FIG. 6 is an enlarged end view of the movable track and the support arm illustrated in FIG. 4.
Figure 5:
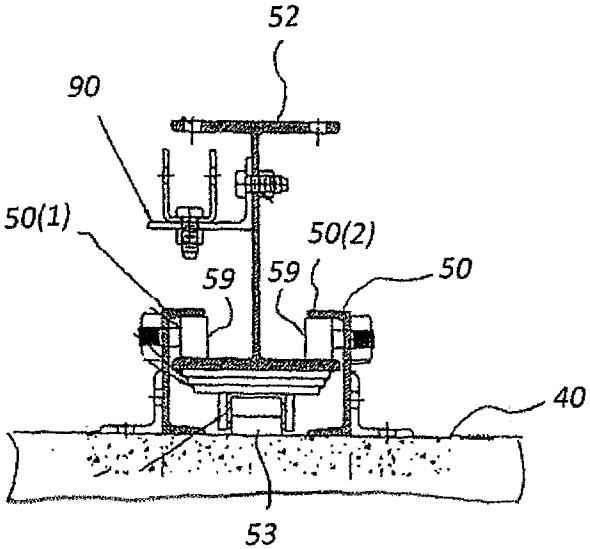
FIG. 5 is an enlarged end view of the fixed track and the movable track illustrated in FIG. 4.

Referring now to FIG. 4-6, the spaced apart fixed tracks 50, the spaced apart movable tracks 52, and the support arms 54 will be discussed in greater detail. The fixed tracks 50 are anchored to the base 40. A length of each fixed track 50 may be about 5 to 6 feet, for example. Each movable track 52 is guided by a respective fixed track 50. A length of each movable track 52 may be about 11 to 12 feet, for example. The actual lengths of the fixed and movable tracks 50, 52 will vary depending on the height and number of concrete wall panels 60 to be formed.

Front and rear rollers 53, 55 carried by the movable track 52 allows the moveable track to move back and forth on the base 40 as desired. An enlarged view of the front rollers 55 is provided in broken-out section 57 in FIG. 4.

A respective support arm 54 is coupled to each movable track 52. Each support arm 54 is configured to pivot in a front or back direction so that the movable front panel form 32 coupled thereto may be positioned in an upright position as desired.

Each fixed track 50 comprises a pair of spaced apart C-shaped rails 50(1), 50(2). The open portions of the C-shaped rails 50(1), 50(2) face each other so as to form a guide channel therebetween, as best illustrated in FIG. 5. The guide channel allows the movable track 52 to move back and forth as desired. Each C-shaped rail 50(1), 50(2) has at least two guide rollers or cam followers 59 that are in direct contact with the movable track 52.

The illustrated movable track 52 is configured as an I-beam. The front and rear rollers 53, 55 are positioned on an underside of the I-beam. The guide rollers 59 carried by the fixed track 50 are positioned within an upper portion of the guide channel so that the lower portion of the I-beam does not contact the C-shaped rails, as best illustrated in FIG. 5.

A brace support clip 90 is carried by the movable track 52. The brace support clip 90 is an attachment end point for attaching a support arm brace 92 between a support arm 54 and a respective movable track 52. Similarly, a front panel form brace 94 may be attached between the front panel form 32 and a respective movable track 52. Likewise, a back panel form brace 96 is coupled between the back panel 30 and the base 40 or at a ground location separated from the base. The front and back panel form braces 94, 96 may also be referred to as pipe braces. In addition, the front and back panel form braces 94, 96 may be telescopic which allows their lengths to be respectively adjusted. In addition, the support arm brace 92 and the front panel form brace 94 are used to pull back the moveable front panel form 32 from the concrete wall panel forming position to the concrete wall panel prep area position.

Figure 7:
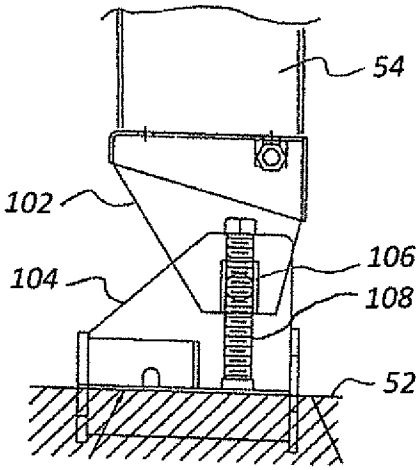
FIG. 7 is an enlarged view of the swivel head interface between the support arm and the movable track illustrated in FIG. 4.

There is a swivel head interface between each support arm 54 and corresponding movable track 52, as best illustrated in FIGS. 6 and 7. The swivel head interface includes an upper plate 102 and a lower plate 104. The upper and lower plates 102, 104 swivel about axle 106. Each swivel head interface includes a pair of thrust bolts 108 to raise or lower the movable front panel form 32 within a half inch to inch range, for example. The pair of thrust bolts 108 allow the movable front panel form 32 to be leveled and squared if needed.

A scaffold 110 may be coupled to an upper portion of the movable front panel 32. A top yoke or cover 120 may be positioned over the concrete wall panel gap 70 when the upright concrete wall panel form apparatus 20 in the concrete wall panel forming position.

For the upright concrete wall panel form apparatus 20 as discussed above, the concrete wall panels 60 are formed having an orientation on its bottom while in the upright position. This means that a height of the back panel form 30 and a height of the movable front panel form 32 is greater than a width of these forms.

Figure 8:
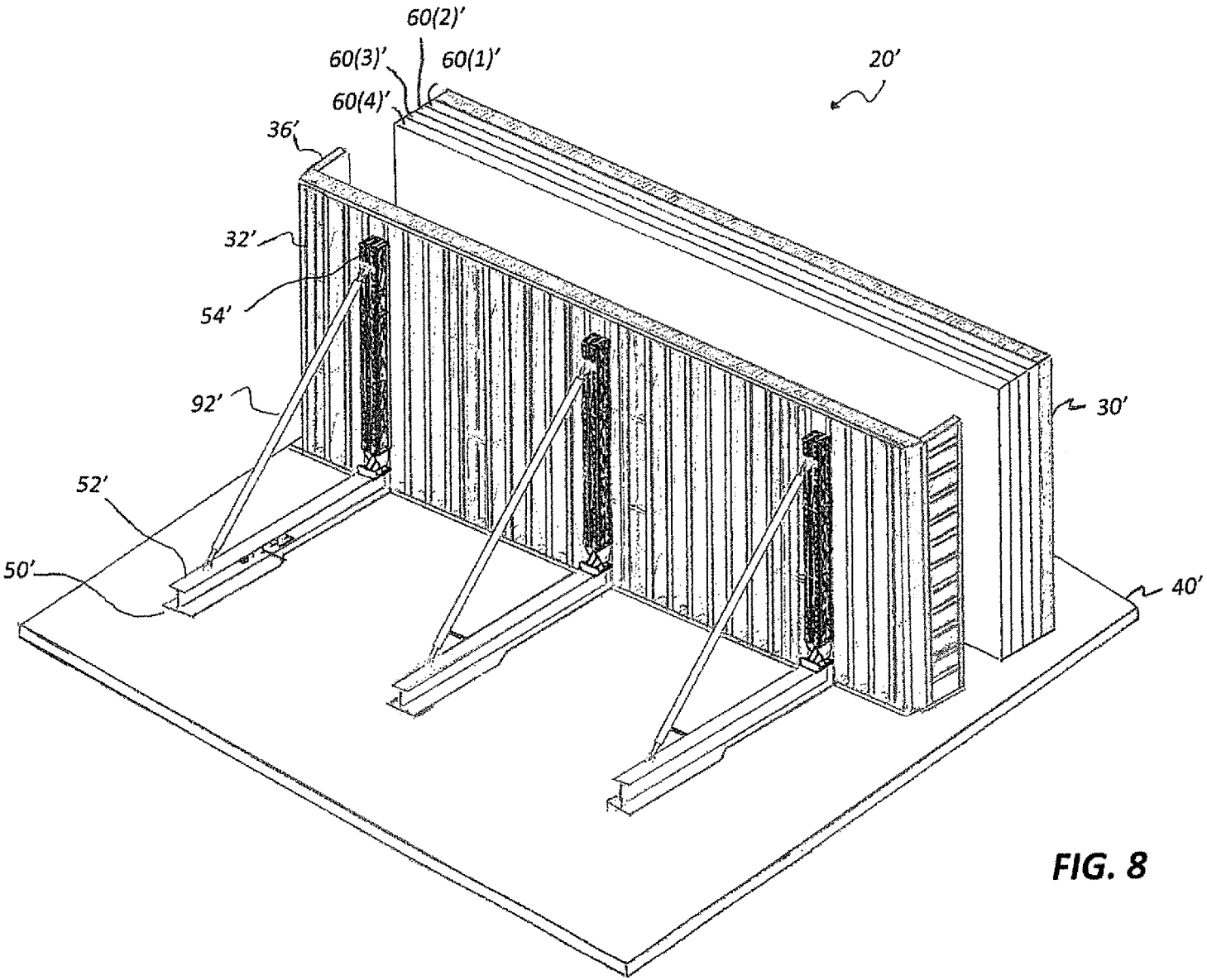
FIG. 8 is a perspective view of another embodiment of the upright concrete wall panel form apparatus illustrated in FIG. 1.

Another embodiment of the upright concrete wall panel form apparatus 20' will be discussed in reference to FIG. 8. In this embodiment, the concrete wall panels 60' are formed having an orientation on its side while in the upright position. This means that a height of the back panel form 30 and a height of the movable front panel form 32 is less than a width of these forms. Since a width of a concrete wall panel is typically 12 feet, as compared to a height that may reach 36 to 40 feet, less pressure is generated by the concrete when poured into the gap 70. Less pressure helps to avoid breakage when moving the concrete wall panels 60 after having been formed. Less pressure means lighter and less expensive panels may be used, and it also means that the chance of failure due to excess of concrete pressure inside the forms is minimized.

Referring now to the back panel form 30, this form may be secured directly to the slab so that it is fixed or non-movable. In another embodiment, the back panel form 30 may be movable. For the back panel form 30 to be movable, a second adjustable support assembly is required. Although not illustrated, the second adjustable support assembly is a mirror image of the adjustable support assembly used to move the movable front panel 32. The second adjustable support assembly is to be secured to the base 40 adjacent the back panel form 30 on a side opposite of the other adjustable support assembly. The back panel form 30 is to be secured to the base 40 via the second adjustable support assembly so that the back panel form 30 is also movable between the concrete wall panel prep area position and the concrete wall panel forming position.

Figure 9:
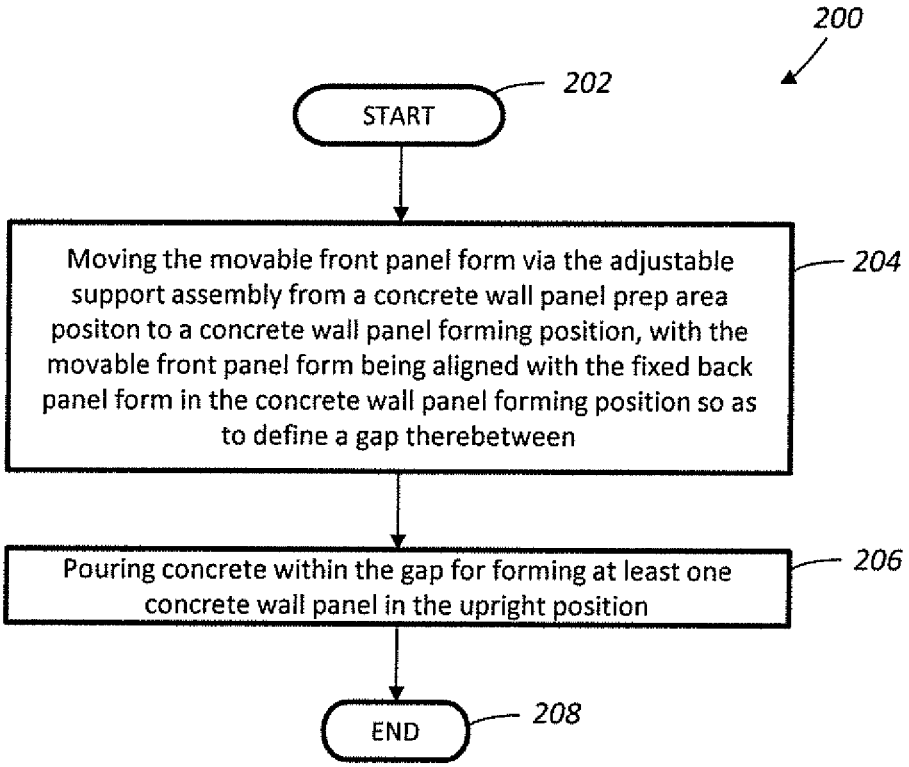
FIG. 9 is a flowchart illustrating a method for using the upright concrete wall panel form apparatus illustrated in FIG. 1.

Referring now to the flowchart 200 in FIG. 9, another aspect is directed to a method of forming concrete wall panels 60 in an upright position using an upright concrete wall panel form apparatus 20 as described above. From the start (Block 202), the method comprises moving the movable front panel form 32 via the adjustable support assembly from a concrete wall panel prep area position (FIG. 2) to a concrete wall panel forming position (FIG. 1), with the movable front panel form 32 being aligned with the back panel form 30 in the concrete wall panel forming position so as to define a gap 70 therebetween. The method further includes pouring concrete within the gap 70 at Block 206 for forming at least one concrete wall panel 60 in the upright position. The movable front panel form 32 is moved via the adjustable support assembly from the concrete wall panel forming position (FIG. 1) back to the concrete wall panel prep area position (FIG. 2) at Block 208. The method ends at Block 210.

That which is claimed:

1. An upright concrete wall panel form apparatus comprising:

a back panel form to be secured to a base in an upright positon;

an adjustable support assembly to be secured to the base adjacent said back panel form, and comprising:

a plurality of spaced apart fixed tracks secured to the base, with each fixed track comprising a pair of spaced apart C-shaped rails having open portions facing each other so as to form a guide channel therebetween, and a plurality of spaced apart movable tracks guided by said plurality of spaced apart fixed tracks, with each movable track configured as an I-beam and carrying front and rear rollers coupled to and centered on an underside of the I-beam within the guide channel and in direct contact with the base, with each C-shaped rail carrying a plurality of guide rollers in direct contact with an upper surface of a lower portion of the I-beam opposite the underside of I-beam;

a movable front panel form supported by said adjustable support assembly in an upright position; and said movable front panel form being moveable via said adjustable support assembly between a concrete wall panel prep area positon and a concrete wall panel forming position, with said movable front panel form being aligned with said back panel form in the concrete wall panel forming position so as to define a gap therebetween to receive concrete for forming at least one concrete wall panel in an upright position.

2. The upright concrete wall panel form apparatus according to claim 1, wherein said movable front panel form is repeatedly movable between the concrete wall panel prep area positon and the concrete wall panel forming position a plurality of times so that forming the at least one concrete wall panel in the upright position comprises forming a plurality of concrete wall panels in the upright position, with each concrete wall panel remaining in place while a next concrete wall panel is formed.

3. The upright concrete wall panel form apparatus according to claim 2, wherein each concrete wall panel contacts an adjacent concrete wall panel so that the concrete wall panels formed after a first concrete wall panel is formed remain in place to be used as a back panel form for a next concrete wall panel to be formed.

4. The upright concrete wall panel form apparatus according to claim 1, wherein said back panel form and said movable front panel are configured so that the at least one concrete wall panel that is formed is orientated on its bottom while in the upright position.

5. The upright concrete wall panel form apparatus according to claim 1, wherein said back panel form and said movable front panel are configured so that the at least one concrete wall panel that is formed is orientated on its side.

6. The upright concrete wall panel form apparatus according to claim 1, further comprising a pair of side panel forms carried by at least one of said movable front panel form and said back panel form so as to cover sides of the gap while in the concrete wall panel forming position.

7. The upright concrete wall panel form apparatus according to claim 1, wherein said adjustable support assembly comprises:

a plurality of support arms carried by said plurality of spaced apart movable tracks, with said plurality of support arms configured to support said movable front panel form in the upright position.

8. The upright concrete wall panel form apparatus according to claim 7, wherein each support arm is configured to pivot front and back with respect to a corresponding one of said movable tracks so as to vertically position said movable front panel form with respect to the base; and move up and down with respect to a corresponding one of said movable tracks so as to level said movable front panel form with respect to the base.

9. The upright concrete wall panel form apparatus according to claim 7, further comprising a plurality of support arm braces coupled between said plurality of support arms and said plurality of movable tracks.

10. The upright concrete wall panel form apparatus according to claim 1, further comprising a second adjustable support assembly to be secured to the base adjacent said back panel form on a side opposite of said adjustable support assembly; and wherein said back panel form is to be secured to the base via said second adjustable support assembly so that said back panel form is also movable between the concrete wall panel prep area positon and the concrete wall panel forming position.

* * * * *